US005857272A

United States Patent [19]

Gallay et al.

[11] Patent Number: 5,857,272

[45] Date of Patent: Jan. 12, 1999

[54] BINDINGS FOR SNOW SHOES HAVING ADJUSTMENT OF LENGTH AND PIVOT AXIS

[75] Inventors: Philippe Gallay, La Clusaz; Christophe Burnet, Saint Martin De Bellevue, both of France

[73] Assignee: Techniques Sports Loisirs, Alex, France

[21] Appl. No.: 944,213

[22] Filed: Oct. 6, 1997

[30] Foreign Application Priority Data

Oct. 7, 1996 [FR] France ..... 96 12397

[51] Int. Cl.[6] ..... A43B 5/16; A43B 5/04

[52] U.S. Cl. ..... 36/125; 36/122

[58] Field of Search ..... 36/122–125

[56] References Cited

U.S. PATENT DOCUMENTS

| | | | |
|---|---|---|---|
| Re. 25,472 | 11/1963 | Howe | 36/125 |
| 4,480,396 | 11/1984 | Lowe et al. | 36/124 X |
| 4,604,817 | 8/1986 | Ramboz | 36/125 |
| 4,620,375 | 11/1986 | Wallace | 36/125 X |

FOREIGN PATENT DOCUMENTS

| | | | |
|---|---|---|---|
| 0 613 703 | 9/1994 | European Pat. Off. . | |
| 0 707 874 | 4/1996 | European Pat. Off. . | |
| 2685647 | 7/1993 | France | 36/122 |
| WO 96/28227 | 9/1996 | WIPO . | |

*Primary Examiner*—B. Dayoan

*Attorney, Agent, or Firm*—Fay, Sharpe, Beall, Fagan, Minnich & McKee

[57] ABSTRACT

A snow shoe (1) has a peripheral frame (2) which defines an interior zone or screen (8). A retention device (3) retains a shoe (4) of a user on the snow shoe. The retention device includes a pivoting plate (7) which is articulated on the screen around a transverse pivoting axle (9), a front strap (10), arranged on the pivoting plate, and a positioning and a control mechanism which permits modification of the longitudinal position of the user's shoe. Specifically, the retention device permits positioning of the front or rear end of the shoe relative to the pivoting axle (7), or of the pivoting axle relative to the screen (8).

11 Claims, 6 Drawing Sheets

FIG 5a
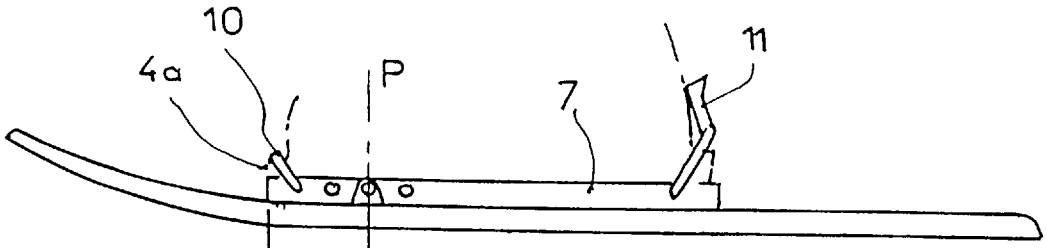
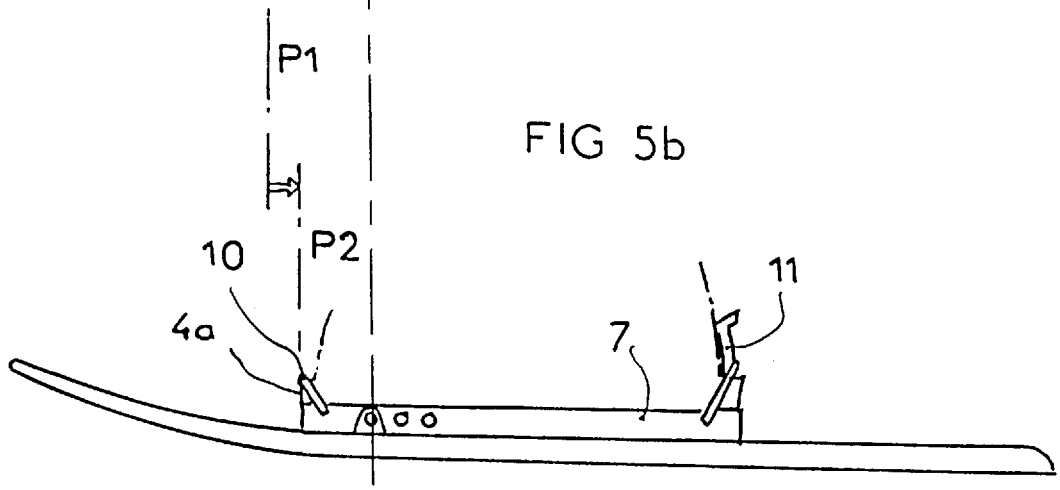
FIG 5b
FIG 5c
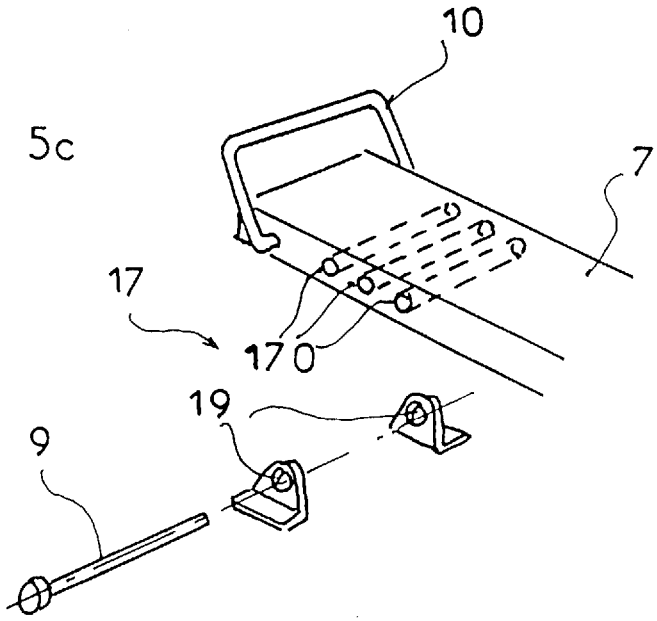

FIG 6a
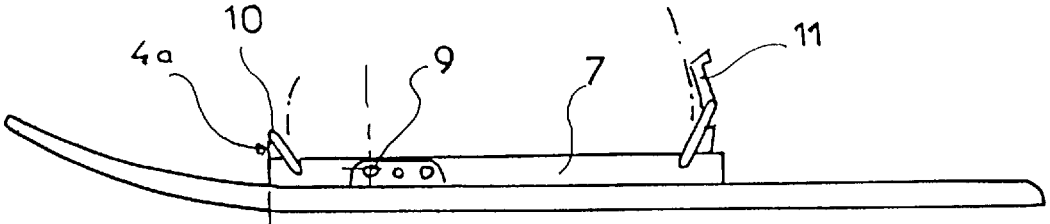
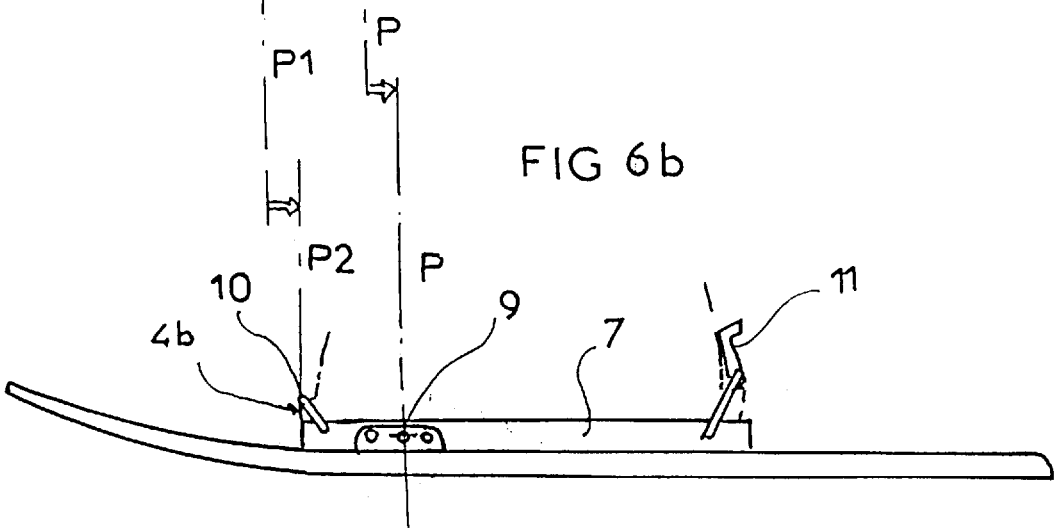
FIG 6b
FIG 6c
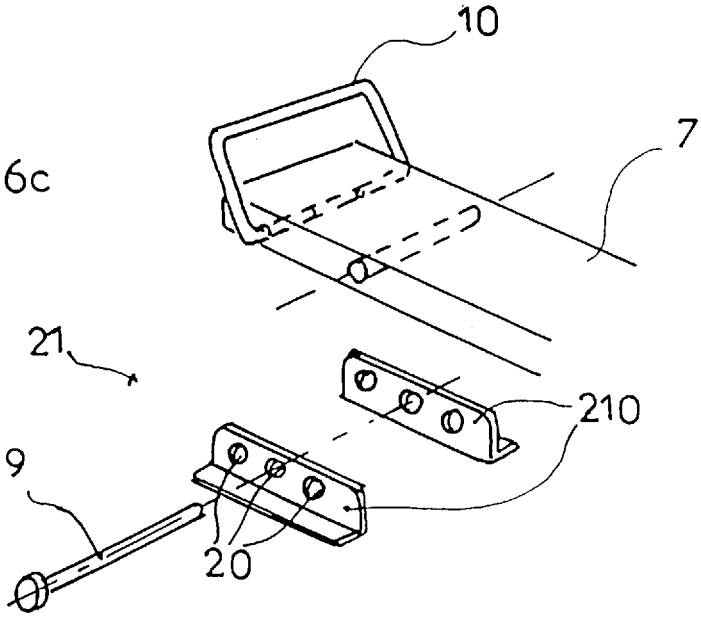

BINDINGS FOR SNOW SHOES HAVING ADJUSTMENT OF LENGTH AND PIVOT AXIS

BACKGROUND OF THE INVENTION

The present invention concerns a snow shoe and, more specifically, an improvement of the retention device for retaining a shoe of a user on the snow shoe.

Snow shoes are instruments which have been known for a great many years because they have been utilized for several centuries by the Scandinavian populations for travelling on snow. Up to this day, snow shoes are utilized for utilitarian or military purposes in order to permit the population or the mountain troops to move on snow for travels required by their daily life. Today, snow shoes are also utilized by walkers or athletic persons for runs and hikes and even for competitive events.

Different types of retention devices already exist in order to retain the shoe on the snow shoe, as for example the plate type, currently utilized by the athletes concerned with performance of the product. This type of device appears to be best adapted to the practice of athletics as well as for recreational snow shoe walks, thanks to its excellent foot hold. On the other hand, these devices present some inherent drawbacks with respect to their utilization, and, indeed, with respect to the diversity of their users. As a matter of fact, this kind of device presents an identical configuration, regardless of the person utilizing the device, and, in general, no consideration is given to the person's physical characteristics such as weight, size, or the size of his shoes. Moreover, the properties of the various practice terrains are not taken into account either in order to best adapt restraining the shoe on the screen of the snow shoe.

The present invention proposes to resolve the drawbacks of this type of snow shoe by proposing an improvement of the restraint which, thanks to simple and reliable means, afford better balance between the physical characteristics of the user, the diversity of the terrains and said snow shoe.

SUMMARY OF THE INVENTION

Thus, according to the invention, tile snow shoe of this type comprises a screen and a shoe retention device of a user, said device being constituted, in part, by front retention means arranged on a pivoting plate, articulated on the screen around a transverse pivot axis, and is characterized in that it comprises positioning and control means, permitting modification of the longitudinal position of the shoe, and specifically its front end relative to the screen and/or relative to the pivot axis and/or the control means, facilitating control of the longitudinal position of the axis relative to the screen.

Thus, according to the invention it is possible to modify the longitudinal position of the shoe relative to the screen and/or the position of the pivot axis relative to said screen.

According to another aspect of the invention, the positioning means and the control means are constituted, in part, by a front control means, permitting longitudinal modification of the respective retention means in front relative to said pivoting plate.

According to another aspect of the present invention, the retention device comprises rear retention means, which are integral with the pivoting plate and a rear control device permitting longitudinal modification of the position with respect to the rear retention means in relation to said pivoting plate.

According to a specific embodiment, the retention device comprises a portion of the principal plate, articulated on the screen, the positioning and control means being constituted, in part, by a portion of the front plate, comprising the front retention means, said portion of the front plate being mounted, in sliding fashion, on the portion of the principal plate, in adjustable manner, according to the more ore less longitudinal axis and includes a portion of the rear plate comprising the rear retention means, said portion of the rear plate being mounted in sliding fashion on a portion of the principal plate, in adjustable manner, longitudinally, according to the axis.

According to another aspect of the present invention, the positioning and the control means comprise a control device, permitting modification of the longitudinal position with respect to the pivoting plate in relation to its pivot axis. In another variation, the positioning and the control means are constituted in part by a control device permitting longitudinal modification of the position with respect to the pivot axis in relation to the screen.

One advantage present invention is that the snow shoe is adaptable to an a range of foot sizes.

Another advantage of the present invention is that the position of the users shoe relative to the screen of the snow shoe is adjustable.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 1 is a view from above of a snow shoe fitted with its retention device.

FIG. 2 represents a lateral view of the snow shoe, on which is attached the shoe of a user.

FIG. 3*a* illustrates a lateral view of the snow shoe and of its retention device for a large size shoe.

FIG. 3*b* illustrates in similar lateral view said snow shoe of FIG. 3*a* supporting the same shoe in a different longitudinal position.

FIG. 3*c* represents a lateral view of said snow shoe supporting a small size shoe.

FIG. 3*d* is a perspective view from the front of the plate with its control device for the front retention position of the shoe.

FIG. 4*a* represents a lateral view of the snow shoe fitted with said retention device in advanced position.

FIG. 4*b* is a lateral view of the snow shoe fitted with the retention device in a rearward position.

FIGS. 5*a*, 5*b* and 5*c* illustrate a third specific embodiment of the device according to the invention according to which the longitudinal position of the fixation is adjustable in relation to the screen of the snow shoe.

FIG. 5*a* represents a lateral view of the snow shoe fitted with the retention device in a center position.

FIG. 5*b* represents a similar view in an advanced longitudinal position.

FIG. 5*c* is an exploded perspective view, depicting the front extremity of the plate with its control device.

FIGS. 6*a*, 6*b* and 6*c* show a fourth specific embodiment of the invention according to which the pivot axis can be controlled in a longitudinal position in relation to the screen of the snow shoe.

FIG. 6*a* represents a lateral view of the snow shoe and of the retention device.

FIG. 6*b* is a lateral view of the snow shoe and of the retention device in a different longitudinal position.

FIG. 6*c* is an exploded perspective view showing the front extremity of the plate with the control device.

DETAILED DESCRIPTION OF THE PREFERRED EMBODIMENTS

Figure 1:
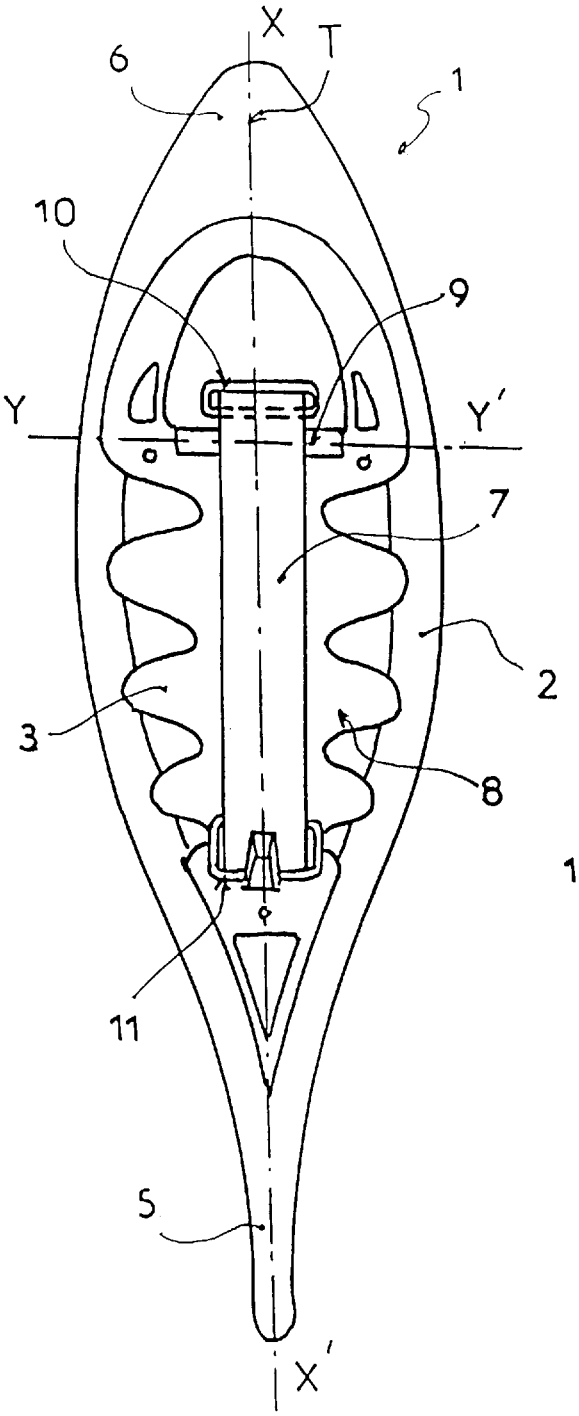
FIGS. 1 and 2 illustrate a snow shoe, on which the positioning and control means according to the invention can be utilized.
Figure 2:
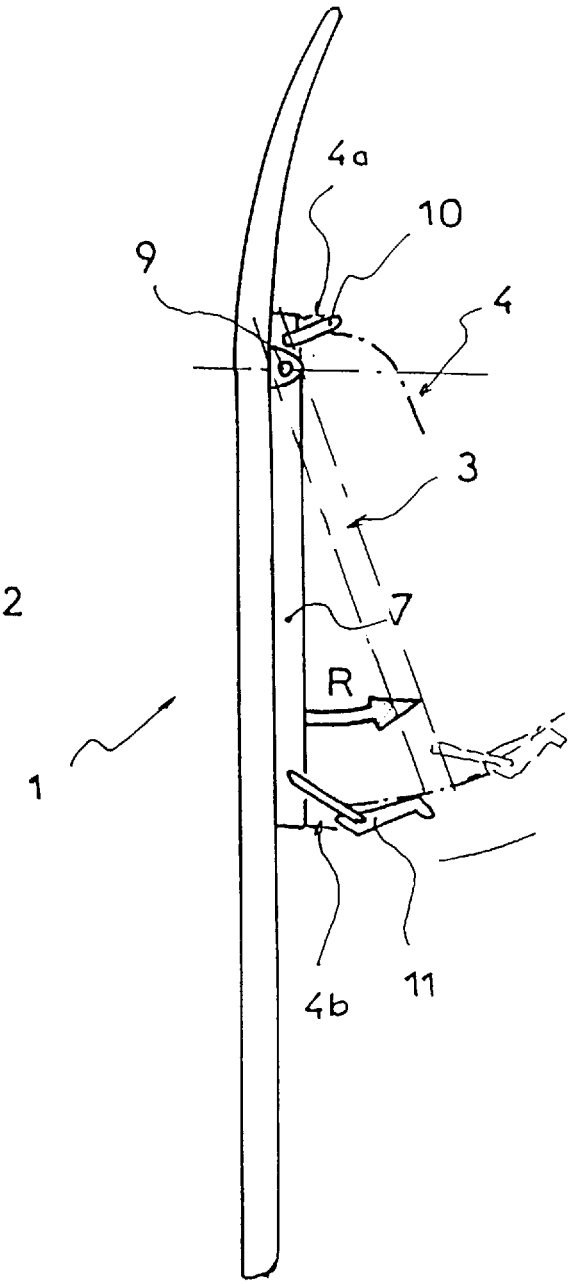

The snow shoe destined to be fitted with the retention device according to the present invention can be of any type, specifically of a type as represented in FIGS. 1 and 2.

Needless to say, said snow shoe can likewise have an asymmetrical shape or any other type without going outside the claimed area of protection of the invention.

The snow shoe identified under general reference (1) has a perforated plate, in the plane of general symmetry (T), and is destined to be fixed under a user's shoe. The snow shoe is composed of a principal frame (2) delimiting an interior zone or screen (8) comprising a group of internal walls supporting the retention device, or fixation (3), said device being destined to retain the shoe (4) of the user. Said principal frame (2) has, for example, a general elongated form, extending toward the rear in a tall (5) of reduced width, whereas the front is raised and of slightly pointed shape so as to constitute a front spatula (6) as illustrated in FIGS. 1 and 2. Needless to say, the snow shoe can have any other form without going outside the scope of the invention.

The shoe (4) of the user is retained on the snow shoe (1) by the retention device (3); it is constituted in general manner by a pivoting plate (7) articulated on the screen (8) around a pivot axle (9) extending approximately transversely according to (YY'). Said pivoting plate (7) supports a front retention means such as a retainer strap (10) destined to retain the front extremity (4*a*) of the shoe (4) and can likewise support a rear retention means (11) permitting retention of a heel (4*b*) of said shoe, as is depicted in FIG. 2. It should be noted that the pivot axle (9) permits pivoting toward the top and toward the bottom of the pivoting plate (7) in the direction of arrow R.

According to one preferred embodiment of a invention, the snow shoe (1) has positioning and control means for permitting modification of the position of the shoe (4) in relation to the screen (8) that is to say, modification of the longitudinal position of the shoe relative to the snow shoe itself. Thus, thanks to the invention, the user could place the front end of his shoes more or less forward and modify the position of said front end in relation to the pivot axle of the plate.

With reference also to FIGS. 3*a*, 3*b*, 3*c* and 3*d*, according to a first specific embodiment, the positioning and control means are constituted by a front control device (13) permitting modification of the position of the front retention means (10) in relation to the pivoting plate (7) according to a more or less longitudinal axle (XX'), that is to say, in relation to the pivot axis (9). The front control device (13) can, for example, be constituted by a succession of holes (14) in which free extremities, or ends (40) of the of the front retainer strap (10) of the shoe are engageable. Thus, the strap (10) could, at leisure, be arranged by the user more or less forward and he would only have to engage the extremities (40) of the strap in the selected holes.

Figure 3A:
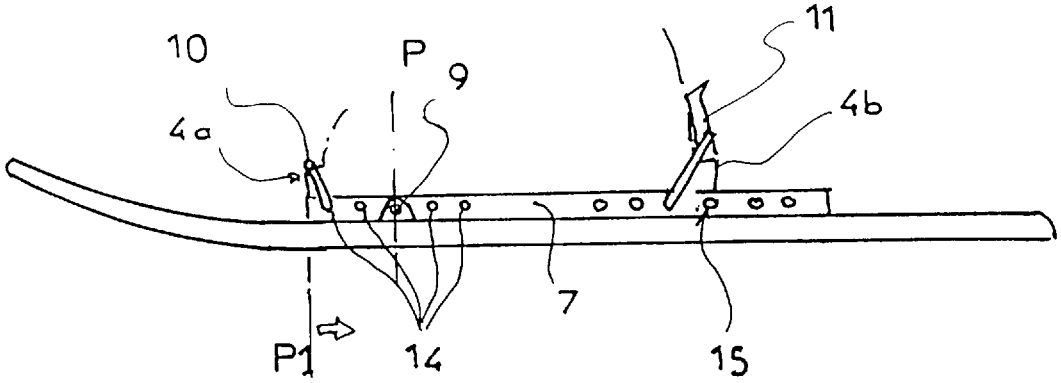
FIGS. 3*a*, 3*b*, 3*c* and 3*d* represent a first specific embodiment of the snow shoe according to the invention.
Figure 3B:
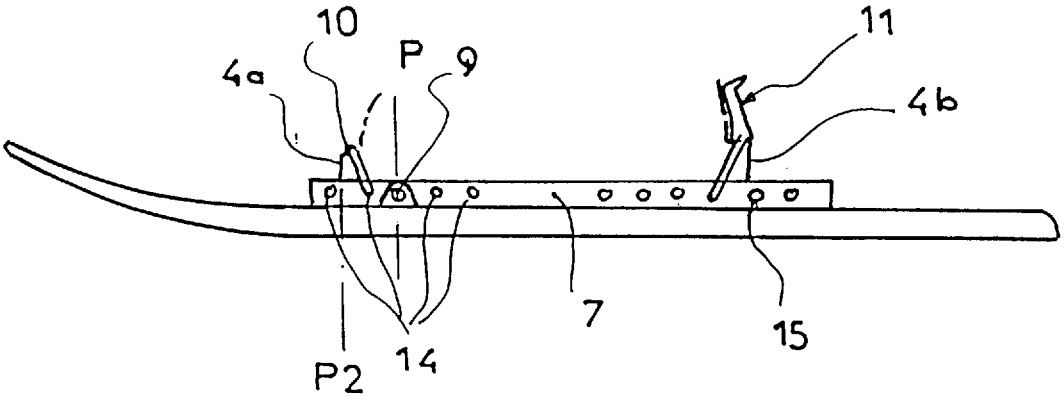

Thus, the front control device (13) permits positioning of the front retention means (10) and, consequently, of the shoe (4) in relation to the pivoting plate (7) integral with the screen (8) of the snow shoe (1), as depicted in FIGS. 3*a* and 3*b*, which illustrate the longitudinal displacement of the front retention means (10) for one specific user. One notes with respect to FIGS. 3*a* and 3*b* that, according to FIG. 3*a*, the position (P1) of the front end (4*a*) of the shoe is more forward and more removed from the position (P) of axis (9) which is not the same end as in position (P2) of FIG. 3*b*, the strap (10) according to the position of FIG. 3*b* being further back than in the position of FIG. 3*a*.

Figure 3C:
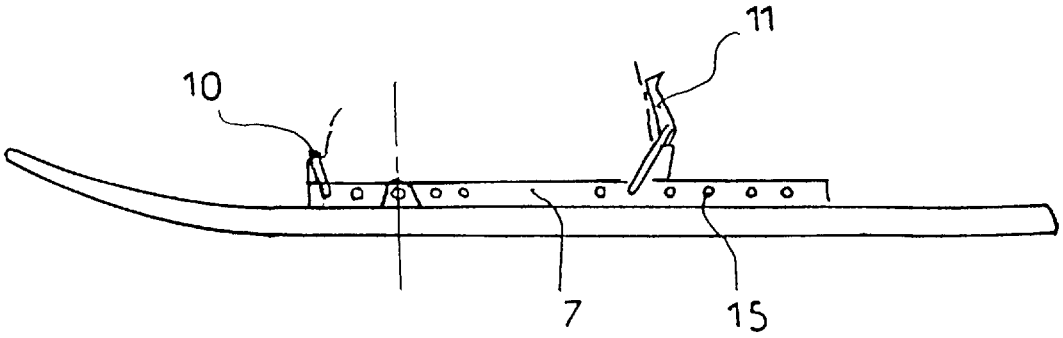
Figure 3D:
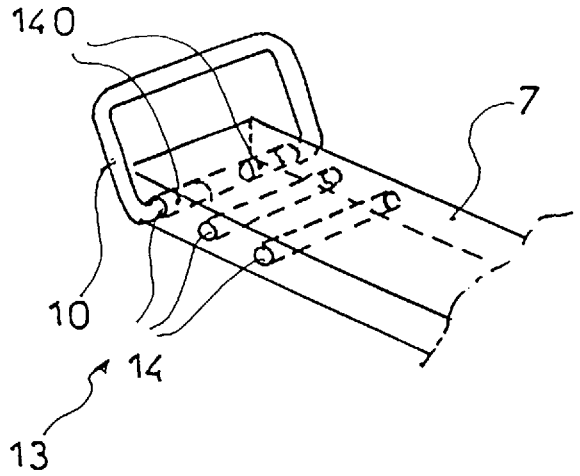

According to this first specific embodiment, the retention device (3) or fixation beneficially has rear retention means (11), whose longitudinal position is also controllable according to a similar system employed for that purpose for a front retention means (10) and which constitutes the rear control device (15) as illustrated in FIGS. 3*a*, 3*b* and 3*c*.

These front (13) and rear (15) control devices, which permit positioning of the front (10) and rear (11) means of retention, can, for example, be constituted by threaded rods, whose turning, driven by a control mechanism, would permit the displacement of said retention means, mounted on nuts, locked during rotation, or by any other equivalent system without going beyond the claimed field of protection.

According to a variation of the first specific embodiment, not represented, the pivoting plate (7) can be constituted by a portion of the front plate, articulated around the pivot axle, on which can glide or be displaced and be locked in the desired rear position a portion of the plate, the front portion of the plate comprising a front control device as previously described, while the portion of the rear plate would beneficially support in fixed manner with its rear end the rear retention means. This would permit avoidance by the user wearing a small size shoe of having behind his heel a plate portion of the pivoting plate which is useless, unsightly and in some cases even embarrassing.

Figures 4A, 4B:
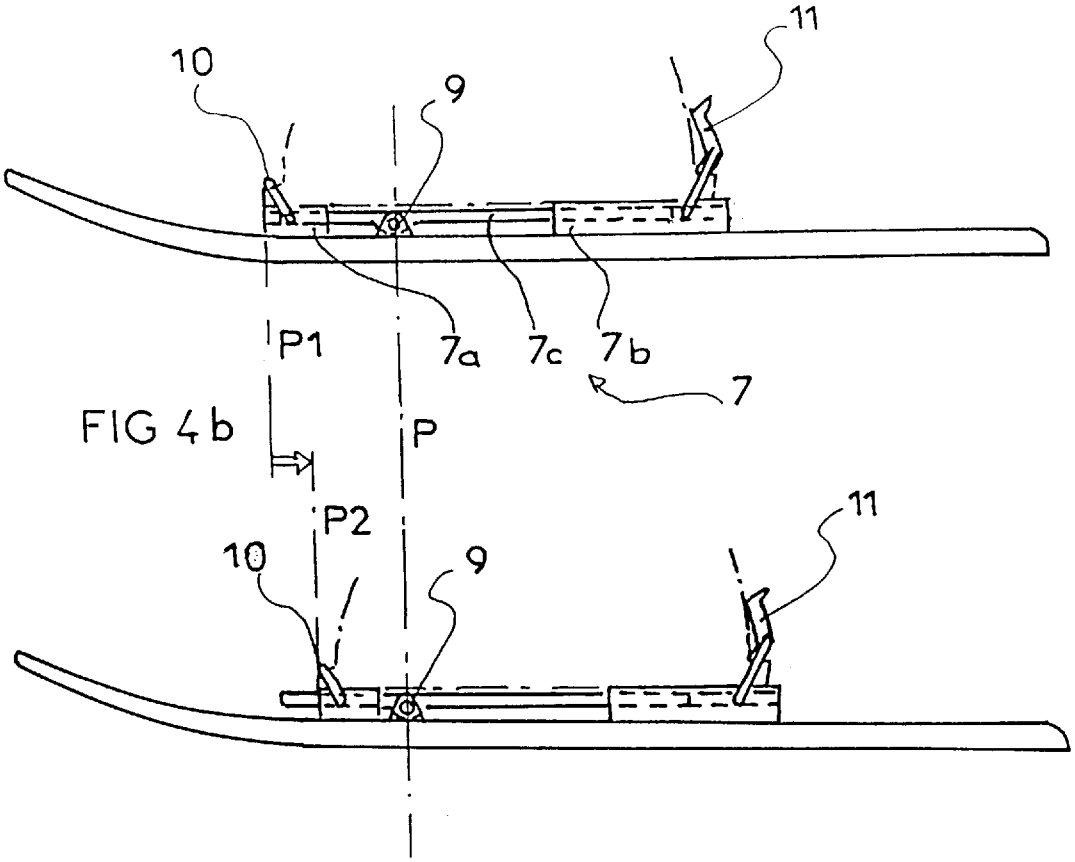
FIGS. 4*a* and 4*b* illustrate a second specific embodiment of the device according to the invention.

According to a second specific embodiment of the invention, illustrated in FIGS. 4*a* and 4*b*, the retention device (3) of the shoe (4) has a pivoting plate (7) constituted by a principal or central portion of the plate (7*c*) articulated around the pivot axle (9) on which can be displaced or slid in longitudinal direction and be immobilized in a preferential front position, a portion of the plate (7*a*) and a rear portion of the plate (7*b*). According to the same specific embodiment, the front retention means (10) and the rear retention means (11) are each beneficially arranged in fixed manner at the end of their respective plate portion in order to avoid said portions to extend useless beyond the front and rear extremities of the shoe (4). Thus, the positioning and control means are consequently constituted by said portions of the front (7*a*) and rear (7*b*) plates installed sliding over a portion of the principal plate (7*c*), and a blocking system permitting the locking of said plate portions in a preferential longitudinal position of the shoe (4) relative to said portion of the central plate (7*c*), in other words, in relation to the screen (8) depicted in FIGS. 4*a* and 4*b*. The blocking system of the front (7*a*) and rear (7*b*) portions of the plate can be constituted, for example, by a glide and pin system, identical to the front (13) and rear (15) control devices of the first specific embodiment. However, the sliding and blocking can likewise be managed by a screw-nut system or any other equivalent system, like a rack. FIG. 4*a* illustrates a first advanced position (P1) while FIG. 4*b* shows a second position (P2) more to the rear and very close to the position P of axle 9.

According to a third specific embodiment shown in FIG. 5, which can specifically constitute a beneficial complement of the preceding specific embodiments, with positioning and control means of the snow shoe being constituted by a control device (17) for the pivoting position of the plate, permitting modification of the longitudinal position of the pivoting plate (7) of the retention device (3) in relation to its pivot axle (9). According to this specific embodiment, the retention device (3) comprises front retention means (10) and rear retention means (11), known per se, destined to retain the shoe (4) of a user on the pivoting plate (7). The control (17) device, during pivoting can, for example, be constituted by a series of positioning holes (170) realized transversely on the pivoting plate (7), said holes (170) being destined to permit passage of the pivot axle (9). Said pivot axle (9) is, for that purpose, arranged detachable through lateral passage openings (19) of the screen. Thus, the plate can be arranged more or less forward in relation to its pivot axle (9), as is illustrated in FIGS. 5*a* and 5*b*. According to the position shown in FIG. 5*b*, the plate is arranged in remote position (P2) toward the rear, while according to the position illustrated in FIG. 5*a*, said plate is in center position (P1) slightly advanced in relation to the position of FIG. 5*b*. Needless to say, one could again modify the position of the plate by still further advancement by engaging axle (9) in one of the transverse holes (19) arranged still more to the rear. Of course, said pivoting control device could be achieved by other equivalent systems not requiring the utilization of a detachable axle, such as, for example, utilizing a bearing, on which the pivoting plate (7) could slide longitudinally according to axis (XX') and be immobilized in preferential position.

According to a fourth specific embodiment shown in FIG. 6, in which the previously cited specific embodiments can easily be combined, the positioning and control means are constituted by a control device (21) permitting modification of the respective longitudinal position of the pivot axle (9) relative to the screen (8). Said control device (21) can be obtained in similar fashion to the pivoting control device (17) described in the third specific embodiment, thanks to two positioning walls (210) extending longitudinally, symmetrically on both sides from the pivoting plate (7) and having two rows of lateral passage openings (210), facing each other, through one of which the detachable pivot axle (9) is intended to pass, as is illustrated in FIGS. 6*a* and 6*b*. Thus, the user can choose one of the holes in the row for positioning more or less forward the pivoting plate relative to the screen, and the pivot axle (9) can thus occupy an advanced position (P) and at least one other remote position (P'). It should also be noted that an improvement, which is not represented, of the third and fourth specific embodiments, almost identical to the variation of the first specific embodiment, consists in realizing a pivoting plate comprising two portions of plates, i.e. a front portion and a rear portion, one of which is articulated around the pivot axle, while the other is mounted in such manner so as to be able to slide and be blocked in relation to same. Said portions of plate support in fixed manner the front retention means or the rear retention means at one of their ends in such manner so that at time of fitting, part of the plate portions will not extend, in useless and awkward manner, in the front or the rear of the shoe of the user.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

We claim:

1. A snow shoe comprising a screen and a retention device for retaining a shoe of a user, said retention device including:

a pivoting plate, the plate being articulated on the screen around a transverse pivot;

a front retention means disposed on the pivoting plate;

and a positioning and control means, which permits modification of a longitudinal position of the shoe in relation to the screen.

2. The snow shoe according to claim 1, wherein the positioning and control means comprises:

a front control device which permits longitudinal modification of a position of the front retention means in relation to said pivoting plate.

3. The snow shoe according to claim 2, wherein the retention device further comprises:

a rear retention means associated with pivoting plate; and, a rear control device which permits longitudinal modification of a position of the rear retention means in relation to said pivoting plate.

4. The snow shoe according to claim 1, wherein the pivoting plate of the retention device comprises:

a principal portion of the plate articulated on the screen; and, a front portion of the plate; and, wherein the positioning and control means comprises:

the front portion of the plate, being mounted on the principal portion of the plate, in an adjustable manner along a longitudinal axis.

5. The snow shoe according to claim 4, wherein the retention device comprises:

a rear portion of the plate; and, rear retention means supported by the rear portion;

said rear portion of the plate being mounted on the principal portion of the plate in longitudinally adjustable manner along the longitudinal axis.

6. The snow shoe according to claim 1, wherein the positioning and control means comprises:

a pivot plate control device which permits modification of the longitudinal position of the pivoting plate relative to the pivot.

7. The snow shoe according to claim 1, characterized in that the positioning and control means comprises:

a pivot control device which permits longitudinal modification of a position of the pivot relative to the screen.

8. A snow shoe comprising:

a peripheral frame;

a central screen connected with the frame;

a plate which supports a user's boot;

a pivot assembly which pivotally connects the plate to the screen for pivotal movement about a pivot axis;

a toe retainer which connects a toe of the user's boot adjacent a front of the plate;

at least one of the toe retainer and the pivot assembly being adjustably connected to the plate such that the pivot axis is adjustable relative to a user's foot; and, a heel retainer which releasably connects a heel of the boot to the plate.

9. The snow shoe according to claim 8 wherein the plate has a plurality of transverse bores defined therein, the pivot assembly being selectively receivable in the bores to adjust its location along the longitudinal length of the plate.

10. The snow shoe according to claim 8 wherein at least one of the toe retainer and the heel retainer are removably received in the bores such that its location along the longitudinal length of the plate is adjustable to adjust where the boot is supported relative to the plate.

11. A method of adjustably mounting a boot in a snow shoe, the method comprising:

pivotally connecting a plate to a snow shoe for pivotal movement through one of a plurality of transverse pivot axes;

connecting a toe retainer adjacent a front portion of the plate in one of a plurality of toe retainer mounting positions;

connecting a heel retainer adjacent a rear portion of the plate in one of a plurality of heel retainer mounting positions;

retaining a toe of the boot in the front retainer; and, releasably retaining a heel of the boot in the rear retainer, whereby the retainers and the pivot axis are adjustable for boots of different sizes and to accommodate the user's preferences for positioning of the boot relative to the pivot axis.

* * * * *